US008448386B2

(12) United States Patent
Floren et al.

(10) Patent No.: US 8,448,386 B2
(45) Date of Patent: May 28, 2013

(54) WINDOW REMEDIATION SYSTEM AND METHOD

(75) Inventors: Mark E. Floren, Woodinville, WA (US); Michael Paul Henry, Seattle, WA (US)

(73) Assignee: 2FL Enterprises, LLC, Kent, WA (US)

( * ) Notice: Subject to any disclaimer, the term of this patent is extended or adjusted under 35 U.S.C. 154(b) by 0 days.

(21) Appl. No.: 12/965,291

(22) Filed: Dec. 10, 2010

(65) Prior Publication Data

US 2011/0138717 A1 Jun. 16, 2011

Related U.S. Application Data

(60) Provisional application No. 61/285,887, filed on Dec. 11, 2009.

(51) Int. Cl.
*E04D 3/38* (2006.01)

(52) U.S. Cl.
USPC ..... 52/60; 52/211

(58) Field of Classification Search
USPC ..... 52/211, 204.1, 204.5, 58, 60, 62, 52/302.1, 306.6, 208
See application file for complete search history.

(56) References Cited

U.S. PATENT DOCUMENTS

| | | | | |
|---|---|---|---|---|
| 1,750,526 | A | 3/1930 | Knox | |
| 2,092,290 | A | 9/1937 | Nyhagen, Jr. | |
| 3,124,427 | A | 3/1964 | Chomes | |
| 4,269,897 | A | 5/1981 | Gans et al. | 428/419 |
| 4,447,989 | A | 5/1984 | Mailand et al. | 49/488 |
| 4,453,855 | A | 6/1984 | Richter et al. | 403/295 |
| 4,462,190 | A | 7/1984 | Allen | 52/58 |
| 4,840,001 | A | 6/1989 | Kimisawa | 52/208 |
| 5,073,321 | A | 12/1991 | Wheeler | 264/102 |
| 5,899,026 | A | 5/1999 | Williams et al. | 52/58 |
| 6,327,820 | B1 * | 12/2001 | Picco | 52/58 |
| 6,401,401 | B1 | 6/2002 | Williams | 52/58 |
| 6,720,071 | B2 | 4/2004 | Ishii | 428/367 |
| 6,725,610 | B2 * | 4/2004 | Murphy et al. | 52/58 |
| 7,059,087 | B2 * | 6/2006 | Allen | 52/58 |
| 7,351,296 | B2 | 4/2008 | Waggoner et al. | 156/71 |
| 2003/0056444 | A1 | 3/2003 | Ackerman, Jr. | 52/58 |
| 2003/0177712 | A1 * | 9/2003 | Gatherum | 52/60 |
| 2003/0215710 | A1 | 11/2003 | Lavoie et al. | 429/212 |
| 2005/0034385 | A1 | 2/2005 | Broad et al. | 52/204.1 |
| 2006/0130426 | A1 * | 6/2006 | O'Rourke et al. | 52/745.16 |
| 2007/0220818 | A1 * | 9/2007 | Teodorovich | 52/204.1 |
| 2008/0044731 | A1 | 2/2008 | Nishio et al. | 429/317 |
| 2008/0092463 | A1 * | 4/2008 | Poirier et al. | 52/204.5 |
| 2008/0141597 | A1 | 6/2008 | O'Rourke et al. | 52/62 |
| 2009/0145067 | A1 | 6/2009 | Tatley et al. | 52/411 |
| 2010/0064607 | A1 | 3/2010 | Warunek | 52/213 |

FOREIGN PATENT DOCUMENTS

KR 10-0635263 B1 10/2006

* cited by examiner

*Primary Examiner* — Brian Glessner
*Assistant Examiner* — Beth Stephan
(74) *Attorney, Agent, or Firm* — Seed IP Law Group PLLC

(57) ABSTRACT

A window remediation system having a sill member coupled to exterior sheathing adjacent a through-opening and another portion extending into a lower region of the opening, a plurality of corner members each having a body configured to be coupled to the exterior sheathing between the exterior sheathing and a siding panel, a pair of side jambs each having a body configured to be coupled to the exterior sheathing and a return flange extending into the through-opening, the side jambs overlapping a portion of opposing corner members, and a head flashing member having an awning element, a first securing tab, and a second securing tab, and a slotted sidewall to receive the side jambs.

12 Claims, 6 Drawing Sheets

WINDOW REMEDIATION SYSTEM AND METHOD

CROSS-REFERENCES TO RELATED APPLICATIONS

This application claims the benefit of U.S. Provisional Application No. 61/285,887, titled "WINDOW REMEDIATION SYSTEM AND METHOD", filed on Dec. 11, 2009, which is hereby incorporated by reference.

BACKGROUND

1. Technical Field

The present disclosure pertains to sealing through-openings in buildings, and more particularly, to a system and method for window remediation that provides an environmental barrier against weather elements at through-openings.

2. Description of the Related Art

Windows and sliding doors are increasingly retrofitted to replace single pane windows with multiple pane windows, or to install vinyl windows. Multiple layer windows better insulate building interiors and minimize climate control requirements in the building. Vinyl windows further provide improved insulation, aesthetics, and durability. Windows and sliding doors can of course be retrofitted for other reasons, such as to replace worn frames or windows with broken or otherwise damaged window glasses.

Removal of old windows is typically accomplished by removing the glass, followed by collapsing the frame inward by prying the frame away from the sides of the through-opening of the building to which the window frame is installed. This process can damage weather resistant barriers, such as leak preventing papers, which are installed during original construction of buildings. Moreover, conventional retrofit window installations include a window in a frame that is simply fastened to the structure that forms the through-opening. Therefore, fluid leaks around the new window are a common problem due to the degraded weather resistant barrier.

BRIEF DESCRIPTION OF CONTENTS OF THE APPENDICES

Appendix A includes a description and photos of a window remediation system and method according to one embodiment.

Appendix B includes a description of a window remediation system and method according to one embodiment.

DETAILED DESCRIPTION

Figure 1:
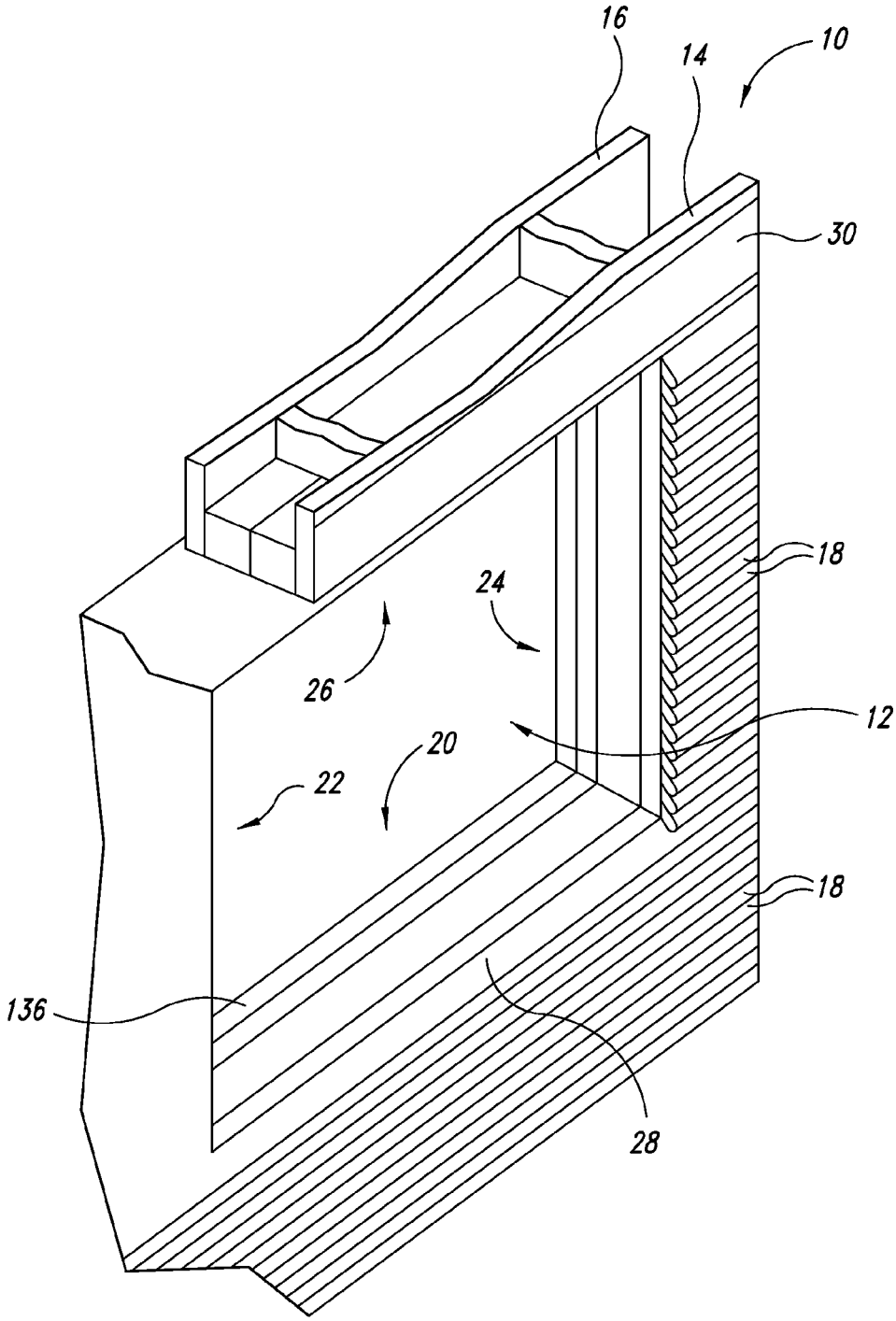
FIG. 1 is an isometric view, schematically illustrating a portion of a building wall with a through-opening and a stabilizing member installed thereto according to one embodiment.

FIG. 1 illustrates a portion of a building wall 10 having a through-opening 12. The wall 10 further includes exterior sheathing 14, applied between an interior board 16 and siding panels 18. The through-opening 12 is defined by a lower opening region 20, a first side region 22, a second side region 24, and an upper region 26.

FIG. 1 illustrates an example of a through-opening 12 in a wall 10 that receives a window. Other building walls may have more or less structural components. FIG. 1 is provided as an example of a wall 10 with an opening 12 therein to provide a context for the following discussion which describes embodiments of the present disclosure relating to window remediation systems and methods.

Figure 2:
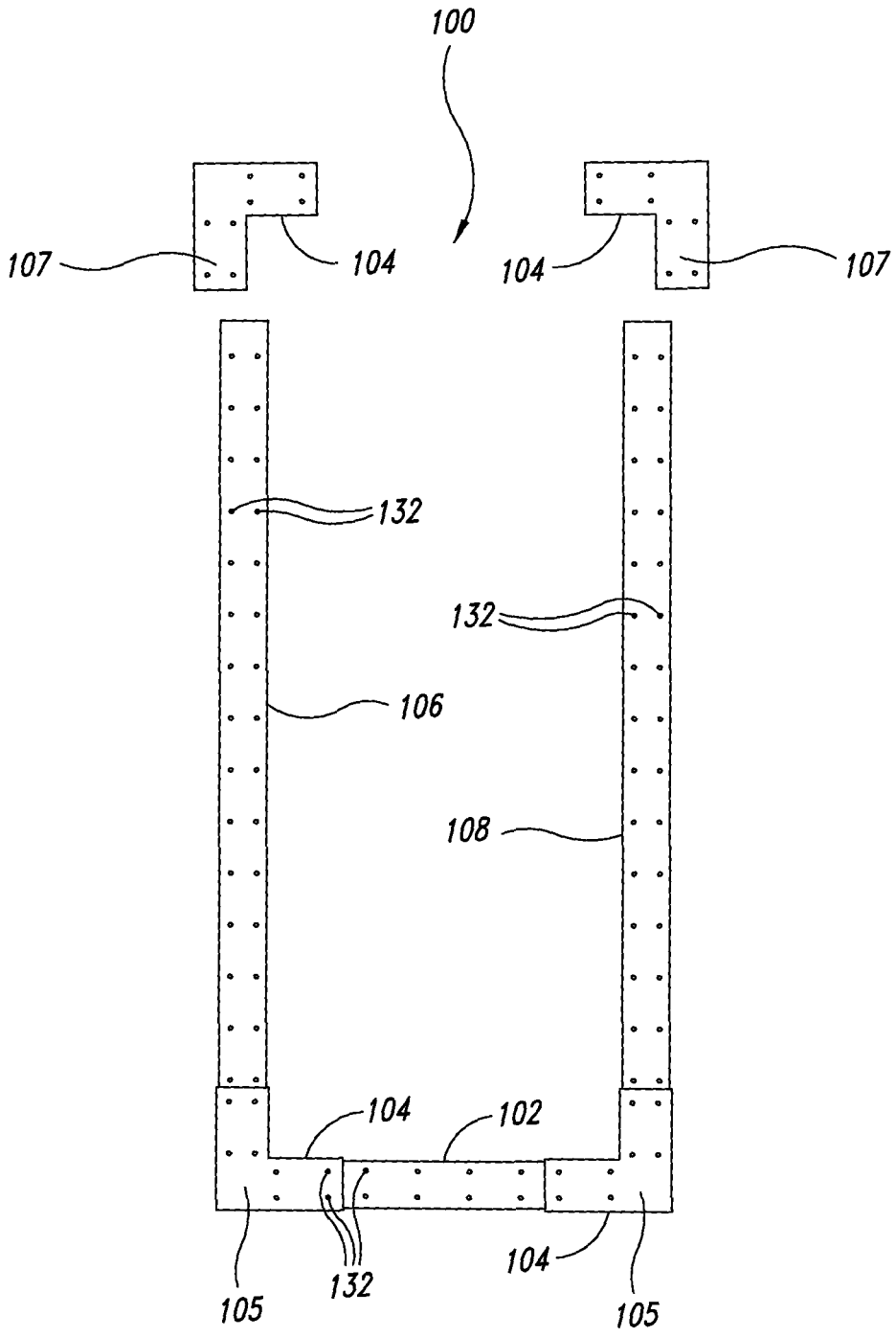
FIG. 2 is a top isometric view depicting corner members, a sill member, and jamb members of a window remediation system according to one embodiment.
Figure 3A:
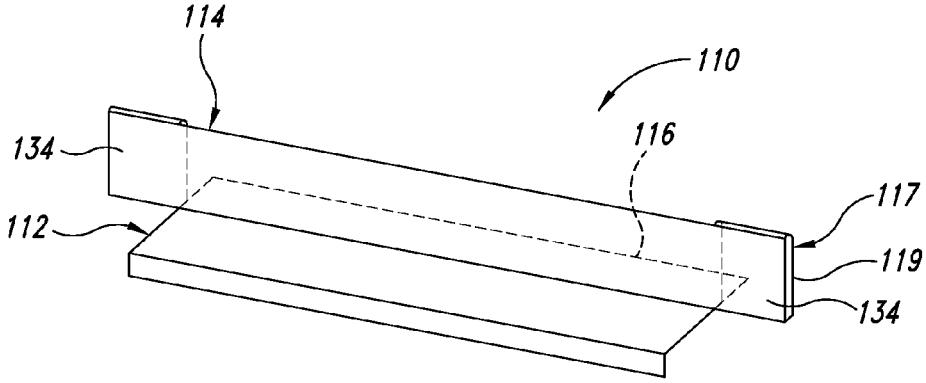
FIG. 3A is an isometric view of a head flashing member of a window remediation system according to one embodiment.

FIG. 2 illustrates a window remediation system 100 prior to assembly according to the present disclosure. The system 100 includes a sill member 102, a plurality of corner members 104, a first jamb member 106, and a second jamb member 108 that collectively form a weather resistant barrier for a retrofitted window or similar structure such as a sliding door. In one aspect, as shown in FIG. 3, the system 100 may further include a head flashing member 110 having an awning element 112, a first securing tab 114 and a second securing tab 116.

Figure 4:
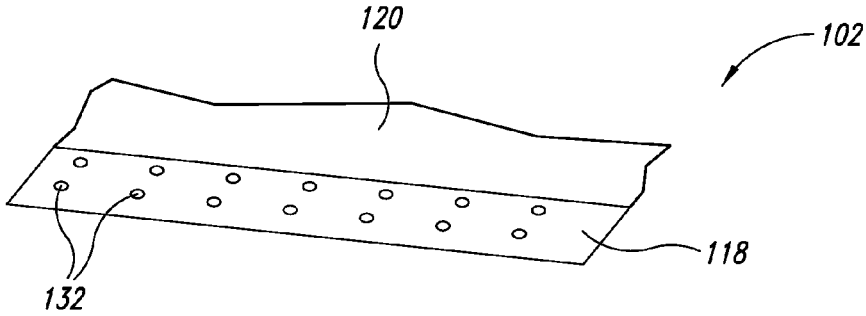
FIG. 4 is an isometric view of a sill member of a window remediation system according to one embodiment.

In one embodiment, the sill member 102 is inserted between the exterior sheathing 14 and a siding panel 28 adjacent the exterior sheathing 14 and mounted to an exterior side thereof. In some embodiments, as illustrated in FIG. 4, the sill member 102 includes a rigid element 118 coupled to a flexible element 120. For example, the rigid element 118 can be fabricated from a material such as a metal, hard or reinforced plastics, and hard or reinforced silicone, while the flexible element 120 can include any one or more of a plastic, silicone, tape, foam, fabric, any combination thereof, or any other suitable flexible material.

The sill member 102 can be bonded to the sheath member using a bonding primer or agent or any other adhesive or adhesives, such as thermosetting adhesives, thermoplastic adhesives, polymeric adhesives, epoxy resins, any combination thereof, or any other suitable adhesive. In one embodiment, the adhesive used is GE SILPRUF® silicone sealant.

The flexible element 120 folds over an upper surface of the lower region 20 of the through-opening 12, extending at an angle, for example at 90 degrees, with respect to the rigid element 118, when installation is complete.

In other embodiments, the sill member 102 may include two rigid elements pivotably connected to one another, such that one of the rigid elements is inserted between the sheathing and the siding and the other folds over the upper surface of the lower region 20 of the through-opening 12.

Figure 5:
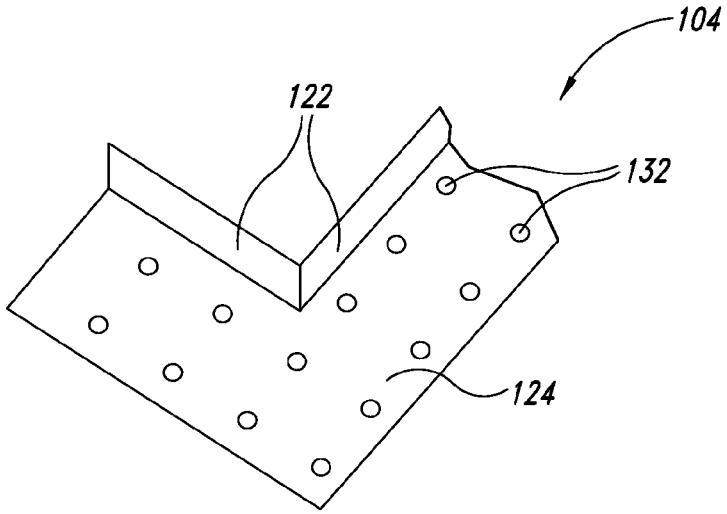
FIG. 5 is an isometric view of a corner member of a window remediation system according to one embodiment.

In one aspect, as illustrated in FIG. 5, the corner members 104 include a return flange 122 along at least a portion of a periphery thereof. The return flange 122 is coupled to, or extends from, a body 124 of each corner member 104. For example, the return flange 122 can extend along the periphery of each corner members 104 at the inner side thereof. The corner members 104 can be made from a unitary body of material, or they can be constituted from more than one piece of material. The corner members 104 can be fabricated from a material such as a metal, hard or reinforced plastics, and hard or reinforced silicone. Other suitable materials are contemplated. In one embodiment, the return flange 122 has a short dimension of about 0.2 inches to 3 inches.

Figure 6:
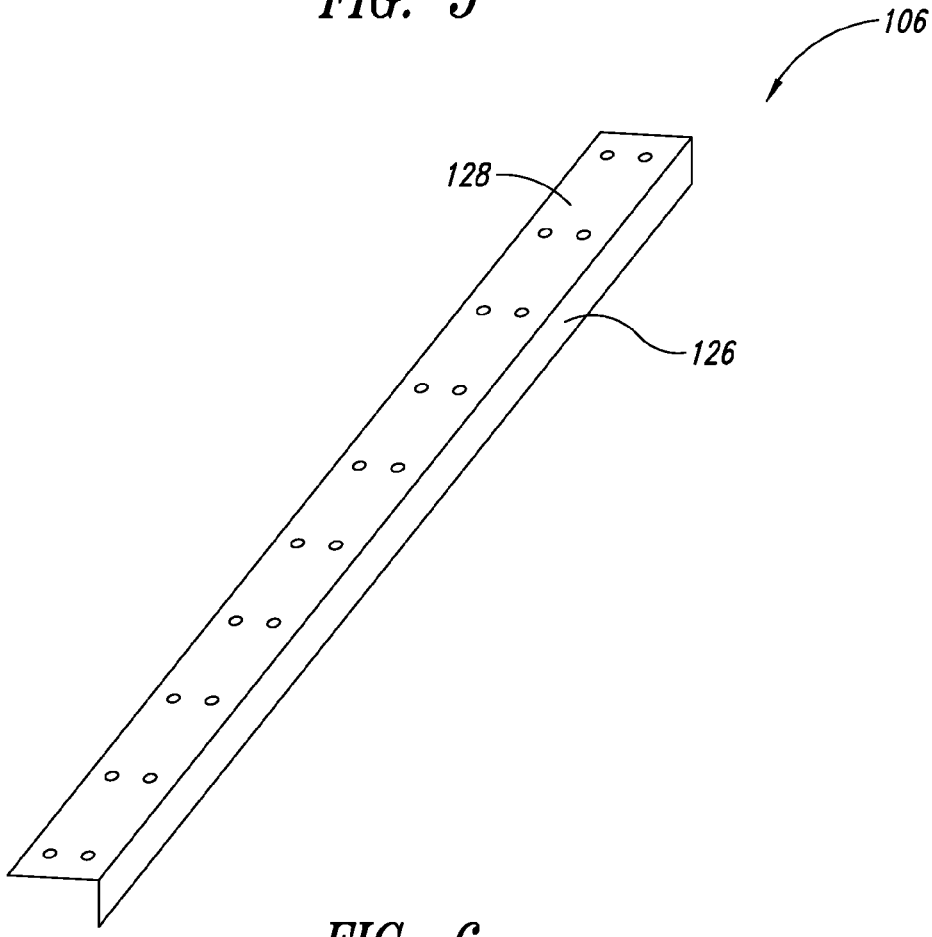
FIG. 6 is an isometric view of a jamb member of a window remediation system according to one embodiment.

As illustrated in FIG. 6, in one aspect, the first and second jamb members 106, 108 include a return flange 126 along at least a portion of a periphery thereof. The last jamb member 106 is illustrated in FIG. 6, and the second jamb member 108 is symmetrical to the first jamb member 106. The return flange 126 is coupled to a body 128 of each of the respective first and second jamb members 106, 108. For example, as shown in FIG. 6, the return flange 126 can extend along the periphery of each of the first and second jamb members 106, 108, at the inner side thereof. The first and second jamb members 106, 108 can be made from a unitary body of material, or they can be constituted from more than one piece of material. the jamb members 106, 108 can be fabricated from a material such as a metal, hard or reinforced plastics, and hard or reinforced silicone. Other suitable materials are contemplated.

In the following discussion, for clarity of description and convenience, two of the four corner members 104, shown in the illustrated embodiments will be referred to as lower corner members 105 and the other two as upper corner members 107. However, there is no intention to limit the scope of the present disclosure to the illustrated embodiments or to a particular orientation or shape of a through-opening. It should be understood that other embodiments of the present disclosure can be configured to accommodate retrofitting a window or similar structure, such as a sliding door, for through-openings of any orientation or shape.

In one aspect, at least a portion of the body 124 of the lower corner members 105 is inserted between the exterior sheathing 14 (shown in FIG. 1) and the siding panel 28, toward the lower region 20 of the through-opening 12, shown in FIG. 1. Similarly, at least a portion of the body 124 of the upper corner members 107 is inserted between the sheathing 14 and a siding panel 130, toward the upper region 26 of the through-opening 12. An outer surface of the body 124 of each corner member 104 is coupled to the exterior sheathing 14.

Moreover, at least a portion of the body 128 of the first and second jamb members 106, 108 is respectively inserted between the exterior sheathing 14 and corresponding siding panels exterior of the exterior sheathing 14, at the first and second side regions 22, 24 of the through-opening 12. An outer surface of the body 128 of each of the first and second jamb members 106, 108, is coupled to the exterior sheathing 14.

In one aspect, the sill member 102, the body 124 of each corner member 104, and the body 128 of each of the jamb members 106, 108, are coupled, affixed, or attached to the sheathing 114 using a bonding primer or agent or any other adhesive or adhesives, such as thermosetting adhesives, thermoplastic adhesives, polymeric adhesives, epoxy resins, adhesive tapes, or any combination thereof, or any other suitable adhesive. In one embodiment, the adhesive used is GE SILPRUF® silicone sealant.

In some embodiments, such as the illustrated embodiment in FIGS. 2-5, at least one of the corner members 104, the first and second jamb members 106, 108, and the sill member 102, includes a plurality of reinforcement features 132, such as a protrusion, convexity, or dimple that, upon assembly of the window remediation system 100, are positioned between the sheathing 14 and the corresponding one of the corner members 104, the first and second jamb members 106, 108, and the sill member 102.

For convenience and clarity of description, the reinforcement features 132 will hereinafter be referred to as dimple 132 without any intention to limit the scope of the present disclosure to a particular shape or construction of the reinforcement features. In one embodiment, the dimples are circular in planform shape and range between 0.15 inches and 0.3 inches in width or diameter, and about 0.001 inches to 0.1 inches in depth or height. The dimples can have any suitable geometric or non-geometric shape such as, without limitation, rectangular, arcuate, circular, or conical. They may also be formed as elongated ridges or channels.

The dimples 132 have been found to significantly improve the rigidity of the corresponding one of the corner members 104, the first and second jamb members 106, 108, and the sill member 102, as well as considerably strengthen the bond between these members and the sheathing 14. Furthermore, the dimples 132 function as stand-offs that slightly space the corresponding member on which they are formed, or to which they are coupled, from the sheathing 14, substantially preventing the bonding agent from being excessively squeezed out from between the sheathing 14 and the corresponding member coupled thereto.

As shown in FIG. 2, the first and second jamb members 106, 108 are configured to partially overlap respective lower corner members 105 toward a lower end of the first and second jamb members 106, 108. Similarly, the first and second jamb members 106, 108 are configured to partially overlap respective upper corner members 107 toward an upper end of the first and second jamb members 106, 108. The respective return flanges 124 of the respective corner members 104 nest in the corresponding return flange 126 of the corresponding first and second jamb members 106, 108. In other embodiments, the jamb members 106, 108 and the corner members 104 can be arranged or assembled such that respective return flanges 126 of the jamb members 106, 108 nest in the respective return flanges 124 of corresponding corner members 104.

Therefore, the inner periphery of the window remediation system 100, at least along the first and second jamb members 106, 108, and the upper and lower corner members 105, 107, are returned inward, creating a rigid weather barrier. Furthermore, the lower region 20 of the through-opening 12 is substantially sealed via the lower corner members 107 and sill member 102. Accordingly, it is not necessary to ascertain the integrity of the original weather barrier paper, which is degraded due to the old window removal and difficult or impossible to access.

Figure 7:
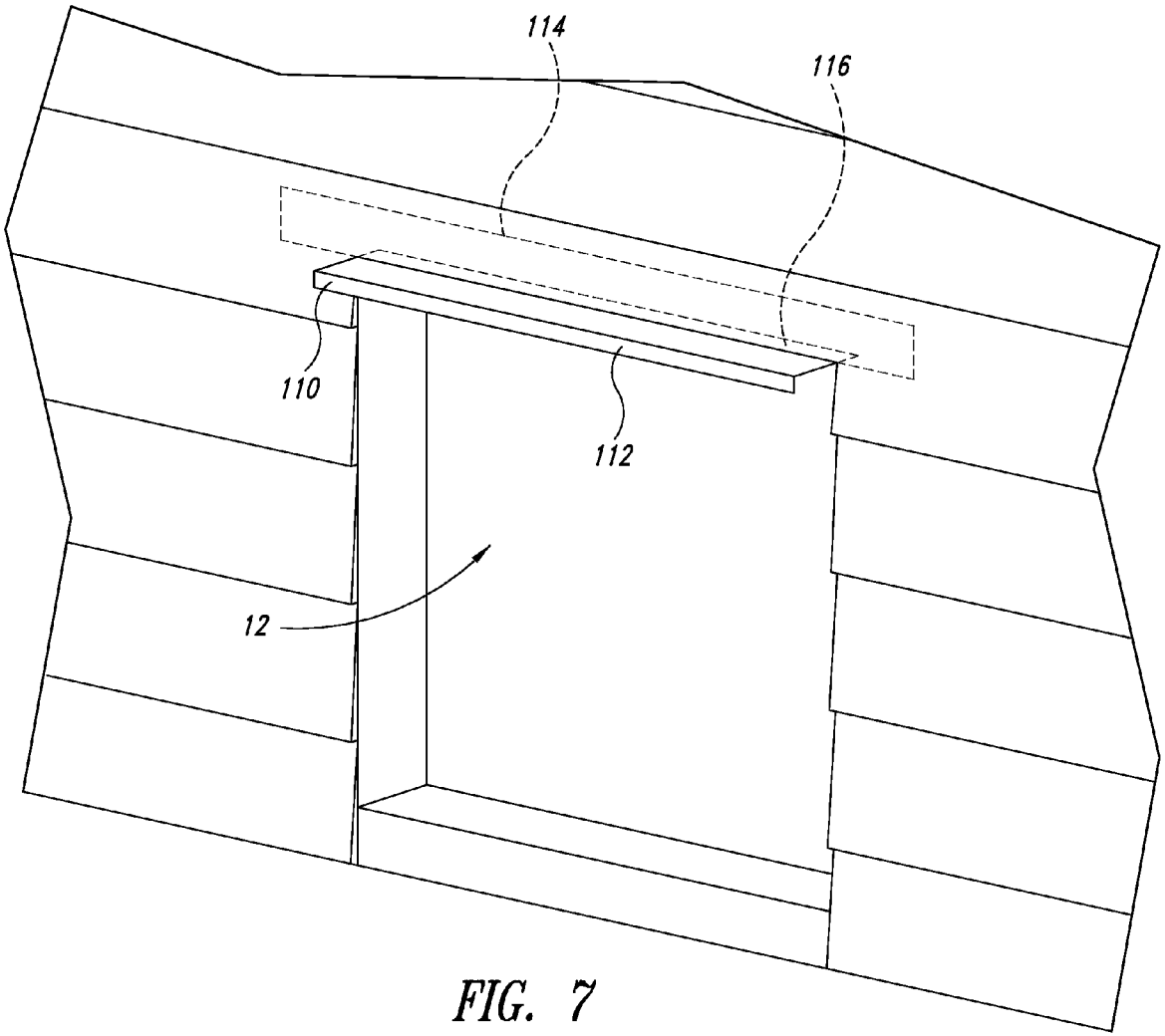
FIG. 7 is a perspective view depicting a through-opening in a building wall with a head flashing member of a window remediation system according to one embodiment.

The upper region 26 of the through-opening 12 is sealed with the head flashing member 110, illustrated in FIG. 3. In one aspect, as illustrated in FIG. 7, the first securing tab 114 extends upward from the awning element 112, and is inserted between the exterior sheathing 14 and the siding panel 130 shown in FIG. 1. The first securing tab 114 can be bonded to the sheathing 14 using a bonding primer or agent or any other adhesive or adhesives, such as thermosetting adhesives, thermoplastic adhesives, polymeric adhesives, epoxy resins, adhesive tapes, or any combination thereof, or any other suitable adhesive. In one embodiment, the adhesive used is GE SILPRUF® silicone sealant.

In one aspect, the second securing tab 116 extends generally into the through-opening 12, and is bonded to the upper region 26, using a bonding primer or agent or any other adhesive or adhesives, such as thermosetting adhesives, thermoplastic adhesives, polymeric adhesives, epoxy resins, adhesive tapes, or any combination thereof, or any other suitable adhesive. In one embodiment, the adhesive used is GE SILPRUF® silicone sealant.

In some embodiments, as illustrated in FIG. 3, the head flashing member 110 can include side walls 134 adjacent each lateral side of the awning element 112. The awning element 112 and side walls 134 divert fluids or other foreign objects away from the through-opening 12 or the window that is installed. Furthermore, the second securing tab 116 can also serve to divert any fluid that may collect above the through-opening 12, toward the originally installed weather barrier paper for being drained out and away from the through-opening 12 and form an interior of the building.

Figure 3B:
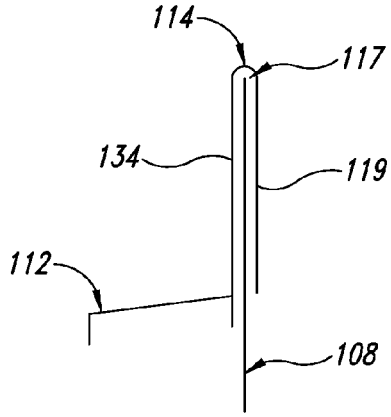
FIG. 3B is a side view of the head flashing member of FIG. 3A.

In some embodiments, the head flashing member 110 may include a slot, for example formed between the side walls 134 and the awning element 112, in which the upper region of the jamb members 106, 108, is received. The slot 117 may in other embodiments be formed by multiple segments 119 of the side wall 134 as shown in FIG. 3B, or between the sidewall and one or more of components of the building structure.

Figure 8A:
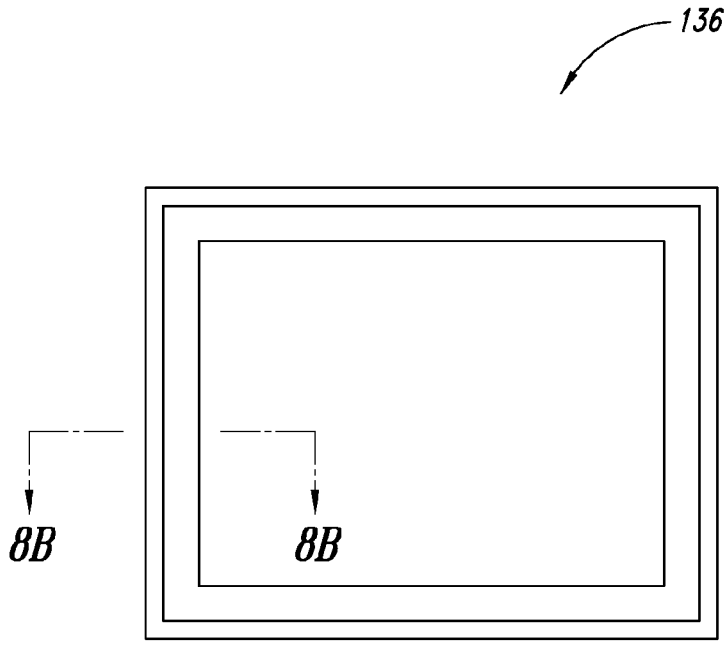
FIG. 8A is a front view of a stabilizing member of a window remediation system according to one embodiment.
Figure 8B:
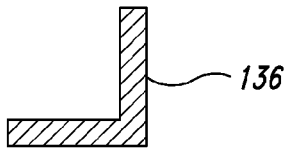
FIG. 8B is a cross-sectional view of a portion of the stabilizing member of FIG. 8A, viewed across section 8B-8B, according to one embodiment.

In some embodiments, the window remediation system 100 includes a stabilizing frame 136 can be incorporated and bonded to the sill member 102. The stabilizing frame 136 can be positioned toward an end of the through-opening 12 facing the building interior. As shown in FIGS. 8A and 8B, the stabilizing frame may include an "L" cross-section formed by two legs, one leg being bonded to the sill member 102 and the other leg mating flush with an interior trim liner of the new window. Other suitable configurations and cross-sections are contemplated.

Accordingly, the entire periphery of the through-opening 12 is substantially sealed by the sill member 102, corner members 104, first jamb member 106, second jamb member 108, and head flashing member 110.

A bonding element is then applied to at least a portion of surfaces of the return flanges of the corner members 104 and of the first and second jamb members 108, facing the through-opening 12. The bonding element is also applied to the securing tab 116 of the head flashing member 110 and to the portion of the sill member 102 that extends into the through-opening 12. Portions of the bonding element can also cover the lower region 20, first side region 22, second side region 24 and upper region 26 that define the through-opening 12, shown in FIG. 1. The bonding element can include a thermosetting adhesive, which activates upon application of heat.

The new window is then placed in the cavity and at least partially surrounded by the window remediation system 100 with the bonding element applied. The bonding element secures the new window in the through-opening 12. In one embodiment, the bonding element includes ETERNA-BOND® thermosetting adhesive tape.

Embodiments of the present disclosure alleviate the need for using mechanical fasteners to secure the window remediation system. However, fasteners may be incorporated to fasten the window frame to the jambs or other structure for increased reliability. Caulking may also be added on the exterior and interior sides for further insulation and sealing around the new window frame or the window remediation system according to an embodiment of the present disclosure. Furthermore, the present disclosure provides an expedient retrofit solution for windows or other similar structures, such as sliding doors, while improving the weather barrier features around the window without relying on, or even requiring ascertaining, the integrity of the original weather barrier paper.

In the foregoing description, terms or phrases such as "siding" or "siding panels" are used for convenience and clarity of description. It is contemplated, however, that in some embodiments, components of a window remediation system may be coupled or bonded to an exterior sheathing and any other structure that is incorporated in a given building wall.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A window remediation system for replacing a window of a building having a through-opening, exterior sheathing, and siding panels adjacent the exterior sheathing, the window remediation system comprising:

a sill member having a first segment and a second segment, the first segment configured to be coupled to the exterior sheathing and to be inserted between the exterior sheathing and at least one siding panel, the second segment configured to be coupled to a lower region of the through-opening;

a plurality of corner members each having a body and a return flange, the body configured to be coupled to the exterior sheathing and to be insertably positioned between the exterior sheathing and at least one siding panel, the return flange configured to extend into the through-opening, a portion of the return flange of some of the corner members configured to be positioned on the sill member;

a plurality of side jambs each having a body and a return flange, the body configured to be coupled to the exterior sheathing and to be inserted between the exterior sheathing and at least one siding panel, the return flange configured to extend into the through-opening, the side jambs having longitudinal ends thereof configured to overlap at least a portion of the respective opposing corner members, the return flange of each side jamb configured to be positioned contiguous the return flange of the corresponding corner member; and a head flashing member that includes an awning element, a first securing tab, and a second securing tab, the first securing tab configured to be coupled to the exterior sheathing and to be inserted between the exterior sheathing and at least one siding panel toward an upper region of the through-opening, the second securing tab configured to be coupled to the upper region of the through-opening, the head flashing member further including two side walls adjacent the awning element on opposing lateral sides thereof, the side walls including slot configured to receive the longitudinal end of the respective side jamb.

2. The window remediation system of claim 1, further comprising:

beads formed or coupled to a surface of at least one of the sill member, side jambs, and corner members, protruding toward the exterior sheathing when coupled thereto.

3. The window remediation system of claim 1, further comprising:

a bonding element configured to extend along a periphery of the through-opening and adjacent the return flanges of the corner and side jambs and the second segment of the sill member.

4. The window remediation system of claim 3 wherein the bonding element includes a thermosetting adhesive.

5. The window remediation system of claim 1 wherein the corner members, side jambs, and the first securing tab of the head flashing member are configured to be coupled or bonded to the exterior sheathing via a silicone adhesive.

6. The window remediation system of claim 1 wherein at least a portion of at least one of the sill member, the corner members, side jambs, and the head flashing member are fabricated from a material selected from at least one of a metal, silicone, a polymer, a foam, or a composite.

7. A structure, comprising:

a window that includes:

a through-opening having a lower region and an upper region;

a sill member having a first segment and a second segment, the first segment insertably positioned between exterior sheathing and at least one siding panel, the second segment coupled to the lower region of the through-opening;

a plurality of corner members each having a body and a return flange, the body insertably positioned between the exterior sheathing and siding panel, the return flange extending into the through opening, a portion of the return flange of some of the corner members positioned on the sill member;

a plurality of side jambs each having a body and a return flange, the side jamb body insertably positioned between the exterior sheathing and siding panel, the side jambs having longitudinal ends thereof overlapping at least a portion of opposing corner members, respectively, the return flange of each side jamb positioned contiguous the return flange of the corresponding corner member; and a head flashing member including an awning element, a first securing tab, and a second securing tab, the first securing tab insertably positioned between the sheathing and siding panel, the second securing tab coupled to the upper region of the through-opening, the head flashing member further including two side walls adjacent the awning element on opposing lateral sides thereof, the side walls including a slot in which the longitudinal end of the respective side jamb is received.

8. The window remediation system of claim 7, further comprising:

beads formed or coupled to a surface of at least one of the sill member, the side jambs, and the corner members, and protruding toward exterior sheathing when coupled thereto.

9. The window remediation system of claim 7, further comprising:

a bonding element on a periphery of the through-opening and adjacent the return flanges of the corner and side jambs and the second segment of the sill member.

10. The window remediation system of claim 9 wherein the bonding element includes a thermosetting adhesive.

11. The window remediation system of claim 7 wherein the corner members, the side jambs, and the first securing tab of the head flashing member are coupled or bonded to exterior sheathing via a silicone adhesive.

12. The window remediation system of claim 7 wherein at least a portion of at least one of the sill member, the corner members, the side jambs, and the head flashing member are fabricated from a material selected from at least one of a metal, silicone, a polymer, a foam, or a composite.

* * * * *